US005661377A

United States Patent [19]

Mishin et al.

[11] Patent Number: 5,661,377

[45] Date of Patent: Aug. 26, 1997

[54] MICROWAVE POWER CONTROL APPARATUS FOR LINEAR ACCELERATOR USING HYBRID JUNCTIONS

[75] Inventors: Andrey Mishin, Cupertino; Russell G. Schonberg, Los Altos Hills; Hank DeRuyter, Campbell, all of Calif.

[73] Assignee: Intraop Medical, Inc., Sunnyvake, Calif.

[21] Appl. No.: 390,122

[22] Filed: Feb. 17, 1995

[51] Int. Cl.[6] ..... H05H 9/00

[52] U.S. Cl. ..... 315/505; 315/5.41; 333/117

[58] Field of Search ..... 333/117, 17.1; 315/5.41, 5.42, 500, 505

[56] References Cited

U.S. PATENT DOCUMENTS

| | | | |
|---|---|---|---|
| 2,925,522 | 2/1960 | Kelliher | 315/5.42 |
| 3,147,396 | 9/1964 | Goerz et al. | 315/5.42 |
| 3,202,942 | 8/1965 | Garver et al. | 333/17.1 X |
| 3,582,790 | 6/1971 | Curtis | 333/117 X |
| 4,118,653 | 10/1978 | Vaguine | 315/5.41 |
| 4,162,423 | 7/1979 | Tran | 315/5.41 |
| 5,321,271 | 6/1994 | Schonberg et al. | 250/492.3 |

FOREIGN PATENT DOCUMENTS

| | | | |
|---|---|---|---|
| 131601 | 6/1987 | Japan | 333/117 |
| 533163 | 6/1977 | U.S.S.R. | 315/505 |

OTHER PUBLICATIONS

C. J. Karzmark, et al, "Microwave Accelerator Structures", Medical Electron Accelerators, McGraw–Hill, Inc., 1993, pp. 67–87.

C. J. Karzmark, et al, "Multi–X–Ray Energy Accelerators", Medical Electron Accelerators, McGraw–Hill, Inc., 1993, pp. 189–199.

C. J. Karzmark, "Advances in Linear Accelerator Design for Radiotherapy", Med. Phys. vol. 11, No. 2, Mar./Apr. 1984, pp. 105–128.

J. A. Purdy, et al, "Dual Energy X–Ray Beam Accelerators in Radiation Therapy: An Overview", Nuclear Instruments and Methods in Physics Research, B 10/11, 1985, pp. 1090–1095.

V. A. Vaguine, "Electron Linear Accelerator Structures and Design for Radiation Therapy Machines", IEEE Conf. Application of Accelerators in Research and Industry, Denton, Texas, Nov. 5, 1980, pp. 1–5.

D. Goer, "Linear Accelerator, Medical", Encyclopedia of Medical Devices and Instrumentation, 1988, John Wiley & Sons, vol. 3, pp. 1772–1800.

*Primary Examiner*—Benny T. Lee

*Attorney, Agent, or Firm*—Stanley Z. Cole; William McClellan

[57] ABSTRACT

A control apparatus for controlling RF power supplied to first and second loads is provided. The control apparatus includes a first symmetric hybrid junction having a first port for receiving input RF power, a second port coupled to the first load and a third port coupled to a dummy load. The control apparatus further includes a second symmetric hybrid junction having a first port coupled to a fourth port of the first symmetric hybrid junction and a third port coupled to the second load. First and second variable shorts are respectively coupled to second and fourth ports of the second symmetric hybrid junction. RF power reflected by the first and second variable shorts is controllably directed through the second symmetric hybrid junction to the second load. The amplitude and phase of the RF power supplied to the second load can be controlled independently. In a preferred embodiment, the first and second loads are first and second accelerator guide sections of a linear accelerator, and the control apparatus is used to control the output beam energy of the linear accelerator.

16 Claims, 4 Drawing Sheets

MICROWAVE POWER CONTROL APPARATUS FOR LINEAR ACCELERATOR USING HYBRID JUNCTIONS

FIELD OF THE INVENTION

This invention relates to a microwave power control apparatus and, more particularly, to a control apparatus which permits independent control of amplitude and phase. The control apparatus of the invention is preferably used in a linear accelerator to control output beam energy, but is not limited to such use.

BACKGROUND OF THE INVENTION

Microwave powered linear accelerators are in widespread use for radiotherapy treatment, radiation processing of materials and physics research. In general, such accelerators include a charged particle source such as an electron source, an accelerator guide that is energized by microwave energy and a beam transport system.

In many applications of these accelerators, it is desirable to be able to adjust the final energy of the accelerated particles. For example, the linear accelerator may be used to treat a variety of cancers by delivering a high local dose of radiation to a tumor. Low energy beams may be used to treat certain types of cancers, while higher energy beams may be desirable for deep seated tumors. In general, it is desirable to provide radiation treatment systems that generate beams having energies that can be tailored to the patient's tumor.

Although linear accelerators operate optimally at one energy level, a variety of techniques have been used for varying the output energy of linear accelerators. One approach is to vary the microwave input power to the accelerator guide. This approach has the disadvantages of increasing the energy spread of the beam, reducing electron beam capture and having a limited adjustment range. Another approach has been to use two accelerator guide sections. The microwave power supplied to the accelerator guide sections is variable in amplitude and phase. The particles may be accelerated or decelerated in the second accelerator guide section. An attenuator and a phase shifter are used to control output energy. Such systems tend to be large, complex and expensive.

Other prior art configurations for producing variable energy outputs have included systems in which the beam passes through the accelerator guide two or more times. An example of such a system is the microtron in which electrons make multiple passes of increasing radius through a microwave cavity, and an orbit having the desired energy is selected as the output. Yet another approach uses an energy switch in a side cavity on the accelerator guide.

Prior approaches to variable energy linear accelerators are described by C. J. Karzmark in "Advances in Linear Accelerator Design for Radiotherapy", *Medical Physics*, Vol. 11, No. 2, March–April, 1984, pages 105–128 and by J. A. Purdy et al in "Dual Energy X-Ray Beam Accelerators in Radiation Therapy: An Overview", *Nuclear Instruments and Methods in Physics Research*, B10/11, 1985, pages 1090–1095. Variable energy linear accelerators are also disclosed in U.S. Pat. No. 4,118,652, issued Oct. 3, 1978 to Vaguine and U.S. Pat. No. 4,162,423 issued Jul. 24, 1979 to Tran.

All of the prior art approaches to varying the energy level of a linear accelerator have had one or more disadvantages, including a failure to maintain a narrow energy spectrum at different output energy levels, difficulties in adjusting the energy level, a high degree of complexity, high cost and large physical size.

SUMMARY OF THE INVENTION

According to the present invention, a control apparatus for controlling RF power supplied to first and second loads is provided. The control apparatus comprises a first symmetric hybrid junction having a first port for receiving input RF power, a second port coupled to the first load, a third port coupled to a dummy load and a fourth port. The control apparatus further comprises a second symmetric hybrid junction having a first port coupled to the fourth port of the first symmetric hybrid junction, a third port coupled to the second load, and second and fourth ports. A first variable short circuit element (which hereinafter may be referred to as a "short" or "shorts" since this is a common way that short circuit element(s) are referred to in this art) is coupled to the second port of the second symmetric hybrid junction, and a second variable short is coupled to the fourth port of the second symmetric hybrid junction. RF power reflected by the first and second variable shorts is controllably directed through the third port of the second symmetric hybrid junction to the second load. The amplitude and phase of the RF power supplied to the second load depend on the positions of the first and second variable shorts.

In a preferred embodiment, the control apparatus is used for controlling the output beam energy of a linear accelerator. The linear accelerator comprises a charged particle source for generating charged particles and first and second accelerator guide sections for accelerating the charged particles. The second port of the first symmetric hybrid junction is coupled to the first accelerator guide section, and the third port of the second symmetric hybrid junction is coupled to the second accelerator guide section. A preferred embodiment the linear accelerator comprises an electron linear accelerator for radiotherapy treatment.

The control apparatus preferably includes means for adjusting the first and second variable shorts so as to control the RF power supplied to the second accelerator guide section. The first and second variable shorts may be adjusted by equal increments to change the phase difference between the RF power supplied to the first and second accelerator guide sections. The variable shorts may be adjusted to change the amplitude of the RE power supplied to the second accelerator guide section and to maintain a constant phase relationship between RF power supplied to the first and second accelerator guide sections. Thus, the phase and amplitude of the RF power may be controlled independently.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
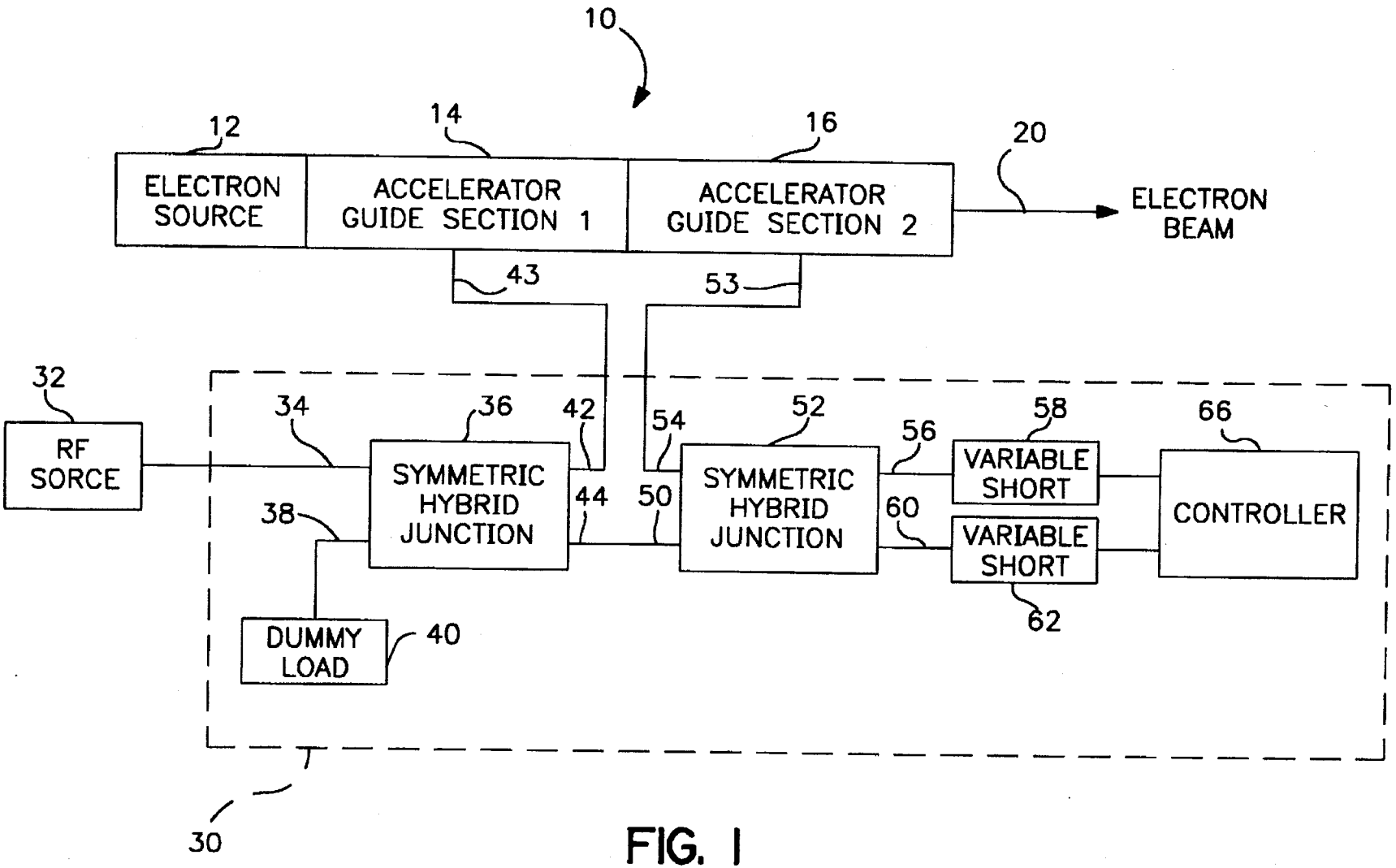
FIG. 1 is a block diagram of microwave power control apparatus in accordance with the present invention used to control the output energy of a linear accelerator.

A block diagram of a linear accelerator system incorporating an example of a microwave power control apparatus in accordance with the present invention is shown in FIG. 1. An electron linear accelerator 10 includes an electron source 12, a first accelerator guide section 14 and a second accelerator guide section 16. Electrons generated by source 12 are accelerated in accelerator guide section 14 and are further accelerated in accelerator guide section 16 to produce an electron beam 20 having an output energy that is adjustable, typically over a range of a few million electron volts (MEV) to about 30 MEV for radiotherapy applications. In some cases, the second accelerator guide section 16 may decelerate the electrons received from accelerator guide section 14 to achieve the desired output energy. The construction of the linear accelerator 10 is well known to those skilled in the art.

Electrons passing through the accelerator guide sections 14 and 16 are accelerated or decelerated by microwave fields applied to accelerator guide sections 14 and 16 by microwave power control apparatus 30. An RF source 32 supplies RF power to a first port 34 of a symmetric hybrid junction 36. The RF source 32 may be any suitable RF source, but is typically a magnetron oscillator or a klystron oscillator. The terms "microwave" and "RF" are used interchangeably herein to refer to high frequency electromagnetic energy. A third port 38 of symmetric hybrid junction 36 is connected to a dummy load 40. A second port 42 of symmetric hybrid junction 36 is coupled to a microwave input 43 of first accelerator guide section 14, and a fourth port 44 of symmetric hybrid junction 36 is coupled to a first port 50 of a second symmetric hybrid junction 52. A third port 54 of symmetric hybrid junction 52 is coupled to a microwave input 53 of second accelerator guide section 16. A fourth port 56 of symmetric hybrid junction 52 is coupled to a first variable short 58, and a second port 60 of symmetric hybrid junction 52 is coupled to a second variable short 62. The variable shorts 58 and 62 are adjusted by a controller 66 to provide RF power of a desired amplitude and phase to accelerator guide section 16 as described below as to result in electron beam 20 passing through the Beam Window (see FIG. 2) in position at the end of accelerator guide section 16 where the window also seals electron linear accelerator 10 from atmospheric conditions, as is well known in the art.

The operation of the control apparatus 30 is described in detail below. In general, the control apparatus 30 permits the amplitude and phase of the RF power supplied to accelerator guide section 16 to be adjusted independently by appropriate adjustment of variable shorts 58 and 62. The variable shorts 58 and 62 can be adjusted by controller 66 to change the amplitude of the RF power supplied to accelerator guide section 16 and to maintain a constant phase shift between the RE power supplied to accelerator guide sections 14 and 16. When the variable shorts are adjusted by equal increments by controller 66, the phase difference between the RF voltage supplied to accelerator guide sections 14 and 16 is changed, and the amplitudes remain constant. The reflected power is partly dissipated in dummy load 40, and the rest of the reflected power is dissipated in the high power RF load of the isolation device 68 connected between port 34 of symmetric hybrid junction 36 and RF source 32 (see FIG. 2).

Figure 2:
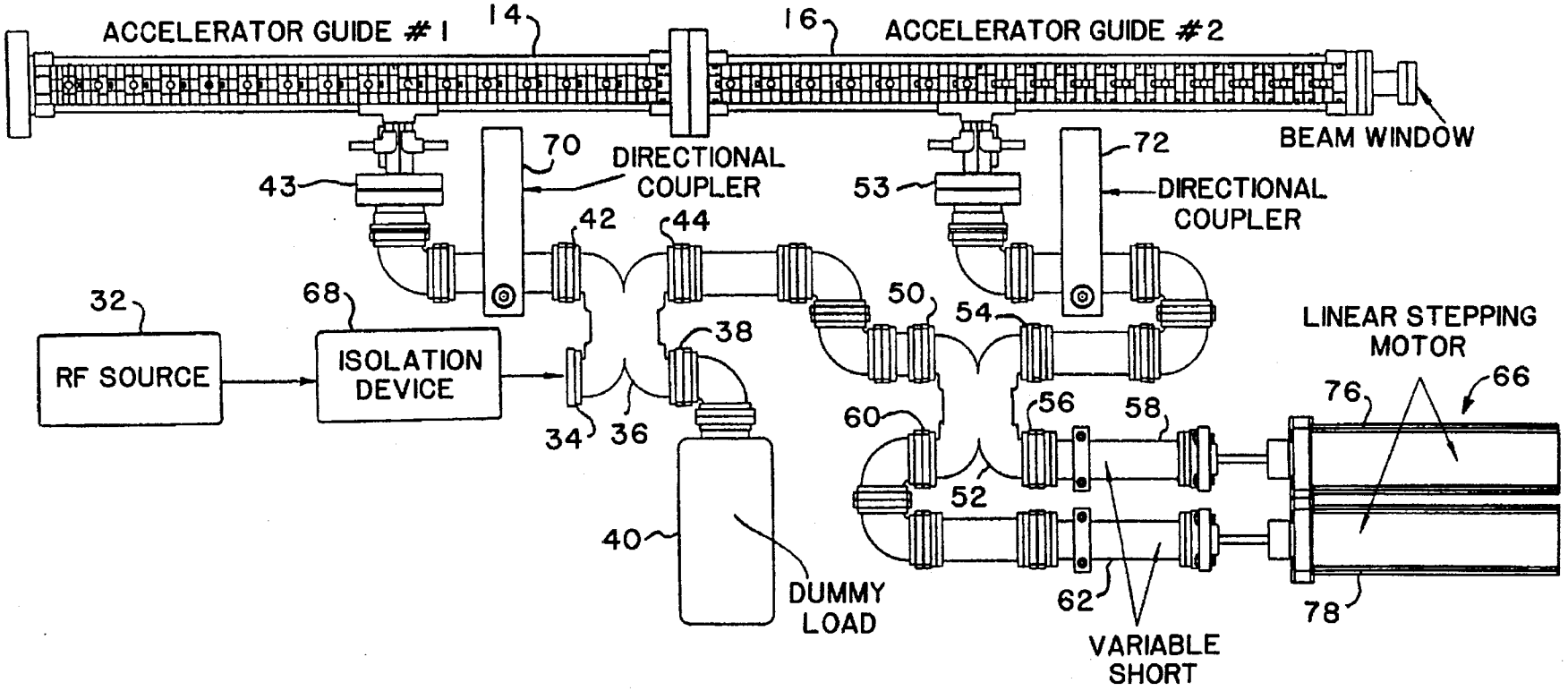
FIG. 2 is a schematic diagram of a preferred embodiment of the invention.

A schematic diagram of a preferred embodiment of the control apparatus of the present invention is shown in FIG. 2. Like elements in FIGS. 1 and 2 have the same reference numerals which are not all described in the discussion herein of FIG. 2. The embodiment of FIG. 2 has generally the same construction as shown in FIG. 1 and described above. Second port 42 of symmetric hybrid junction 36 is connected through a directional coupler 70 to the microwave input 43 of first accelerator guide section 14. Third port 54 of symmetric hybrid junction 52 is connected through a directional coupler 72 to the microwave input 53 of second accelerator guide section 16. The variable shorts 58 and 62 are adjusted by linear stepping motors 76 and 78 of controller 66 respectively. Isolation device 68, such as a four port ferrite circulator, is connected between RF source 32 and first port 34 of symmetric hybrid junction 36. A high power RF load and a low power RF load (both not shown) are connected to the other two ports of the four port circulator.

The embodiment shown in FIG. 2 is designed for operation at 9.3 GHz and controls the output energy of electrons passing through accelerator guide sections 14 and 16 in a range of 4 MEV to 13 MEV. In a preferred embodiment, the symmetric hybrid junctions 36 and 52 are type 51924, manufactured by Waveline, Inc.; variable shorts 58 and 62 are type SRC-VS-1, manufactured by Schonberg Research Corp.; the linear stepping motors 76 and 78 are type K92211-P2, manufactured by Airpax; and the directional couplers 70 and 72 are type SRC-DC-1, manufactured by Schonberg Research Corp. It will be understood that the above components of the control apparatus are given by way of example only, and are not limiting as to the scope of the present invention. One factor in the selection of components for the control apparatus is the frequency of operation of the accelerator guides 14 and 16. Suitable microwave components are selected for the desired operating frequency. The control apparatus of the invention is expected to operate at frequencies in the L, S, X and V bands.

Operation of the control apparatus is as follows. Input RF power to port 34 of symmetric hybrid junction 36 is divided equally between ports 42 and 44. Thus, half of the input RF power is supplied through directional coupler 70 to first accelerator guide section 14, and half of the input RF power is supplied through port 44 to port 50 of symmetric hybrid junction 52. The RF power received through port 50 by symmetric hybrid junction 52 is divided equally between ports 56 and 60. Thus, half of the RF power received through port 50 is supplied to variable short 58, and half of the RF power received through port 50 is supplied to variable short 62. Variable shorts 58 and 62 each comprise a short circuit which is movable along a length of waveguide by the respective linear stepping motors 76 and 78. The short circuit reflects input RF energy with a phase that depends on the position of the short circuit. Thus, variable short 58 reflects RF power back into port 56 of symmetric hybrid junction 52, and variable short 62 reflects RF power back into port 60 of symmetric hybrid junction 52. The RF power received by symmetric hybrid junction 52 through ports 60 and 56 is combined and, depending on the relative phases at ports 60 and 56, is output through port 54 to accelerator guide section 16 and through port 50 to port 44 of symmetric hybrid junction 36. The relative proportions of RF power directed by symmetric hybrid junction 52 to accelerator guide section 16 and to port 44 depends on the phase difference between the RF power at ports 56 and 60. The relative proportions of RF power dissipated in dummy load 40 and directed toward the RF source 32 (which is isolated by isolation device 68) through port 34 of symmetric hybrid junction 36 depends on the phase shift and amplitudes of the backward and reflected power flow in ports 42 and 44.

These characteristics of symmetric hybrid junction 52 are used to control the microwave power supplied to accelerator guide sections. 14 and 16. The RF power supplied to accelerator guide section 14 remains constant in amplitude and phase as the variable shorts 58 and 62 are controlled by the linear stepping motors 76 and 78. When one of the variable shorts 58 and 62 is adjusted, the amplitude of the RF power supplied through port 54 to accelerator guide section 16 changes. In this case, the phase difference between the RF power supplied to accelerator guide sections 14 and 16 changes and is compensated by adjustment of the other variable short so as to maintain a constant phase difference. When the variable shorts 58 and 62 are adjusted by linear stepping motors 76 and 78 by equal increments in the same direction, the phase shift between the RF power applied to accelerator guide sections 14 and 16 changes. In this case, the amplitude of the RF power supplied to accelerator guide section 16 remains constant as its phase is changed with respect to the RF power supplied to accelerator guide section 14. Thus, phase and amplitude can be controlled independently by appropriate adjustment of variable shorts 58 and 62.

While the preferred embodiment of the invention uses symmetric hybrid junctions and variable snorts, equivalent components having the same functions can be used. In particular, an equivalent of the symmetric hybrid junction must divide input RF power between two output ports in the forward direction. In the reverse direction, RF power received through the output ports is directed to the two input ports, with the proportion directed to each port depending on the phase difference between the RF power at the output ports. An example of a suitable symmetric hybrid junction is a topwall hybrid. An equivalent of the variable short must reflect RF energy with a controllable phase.

Figure 3A:
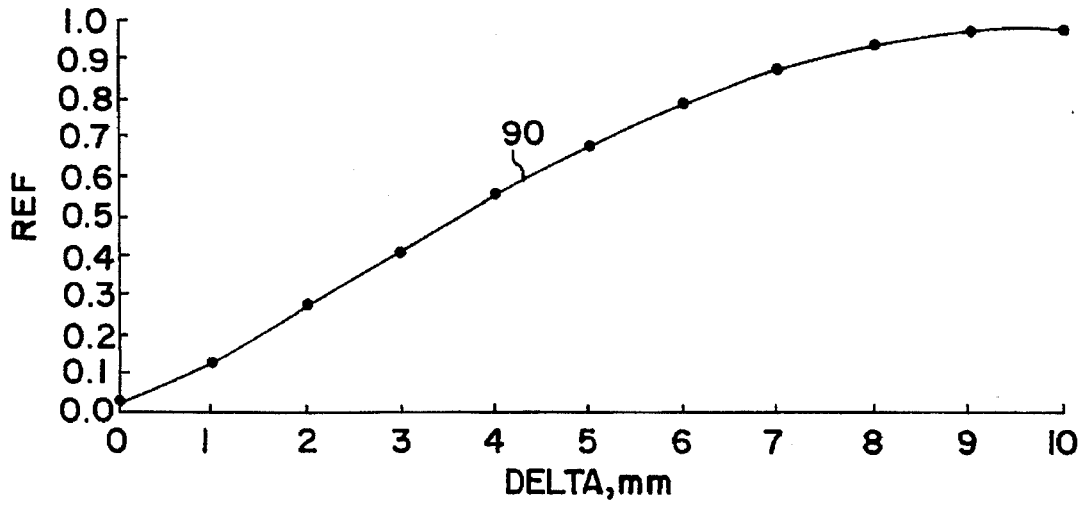
FIG. 3A is a graph of relative reflected power from the first accelerator guide section as a function of the difference in positions of the variable shorts.
Figure 3B:
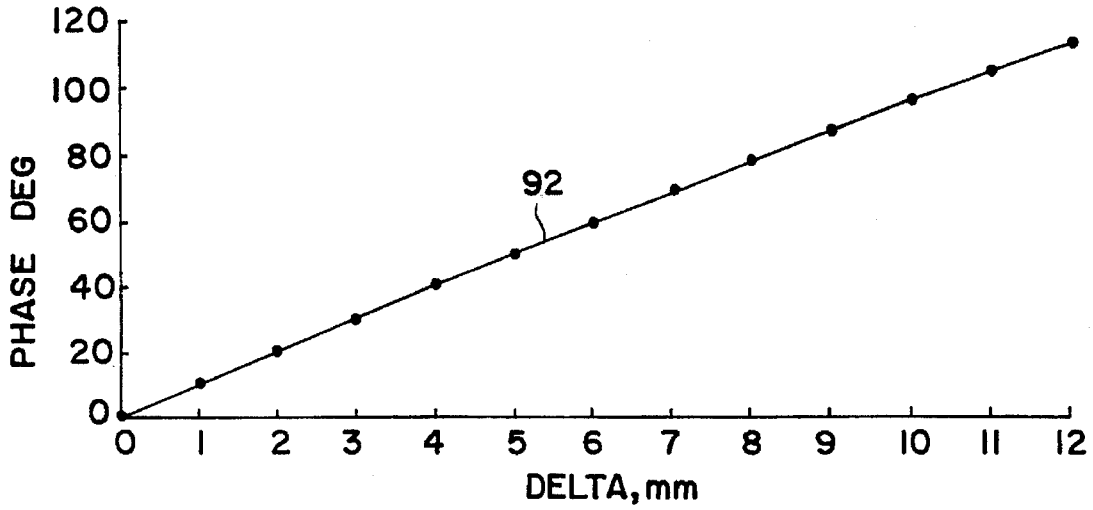
FIG. 3B is a graph of the phase of the RF power supplied to the second accelerator guide section as a function of the positions of the variable shorts when they are moved together.

Measurements were taken of a system as illustrated in FIGS. 1 and 2 and described above. The results are plotted in. FIGS. 3A and 3B. FIG. 3A is a graph of relative reflected power (Ref) from, accelerator guide section 14 to port 42 of symmetric hybrid junction 36 as a function of the difference (Delta) in the positions of the variable shorts 58 and 62 (curve 90). FIG. 3B is a graph of the phase of the RF power supplied through port 54 of symmetric hybrid junction 52 to accelerator guide section 16 as a function of the positions (Delta) of the variable shorts 58 and 62 when they are moved together (curve 92).

The controller 66 may include a control unit (not shown) for controlling the stepping motors 76 and 78. The positions of variable shorts 58 and 62 to obtain selected energies of electron beam 20 are determined empirically. The required positions are preprogrammed into the control unit. During operation, the stored positions to obtain a desired energy are selected and are used to actuate stepping motors 76 and 78. A cross check may be provided by monitoring the forward and reflected power applied to the second accelerator guide section 16. The ratio of forward to reflected power can be compared with high and low limits for each energy of operation. When the ratio is outside the limits, operation can be terminated as a protective interlock mechanism.

Figure 4:
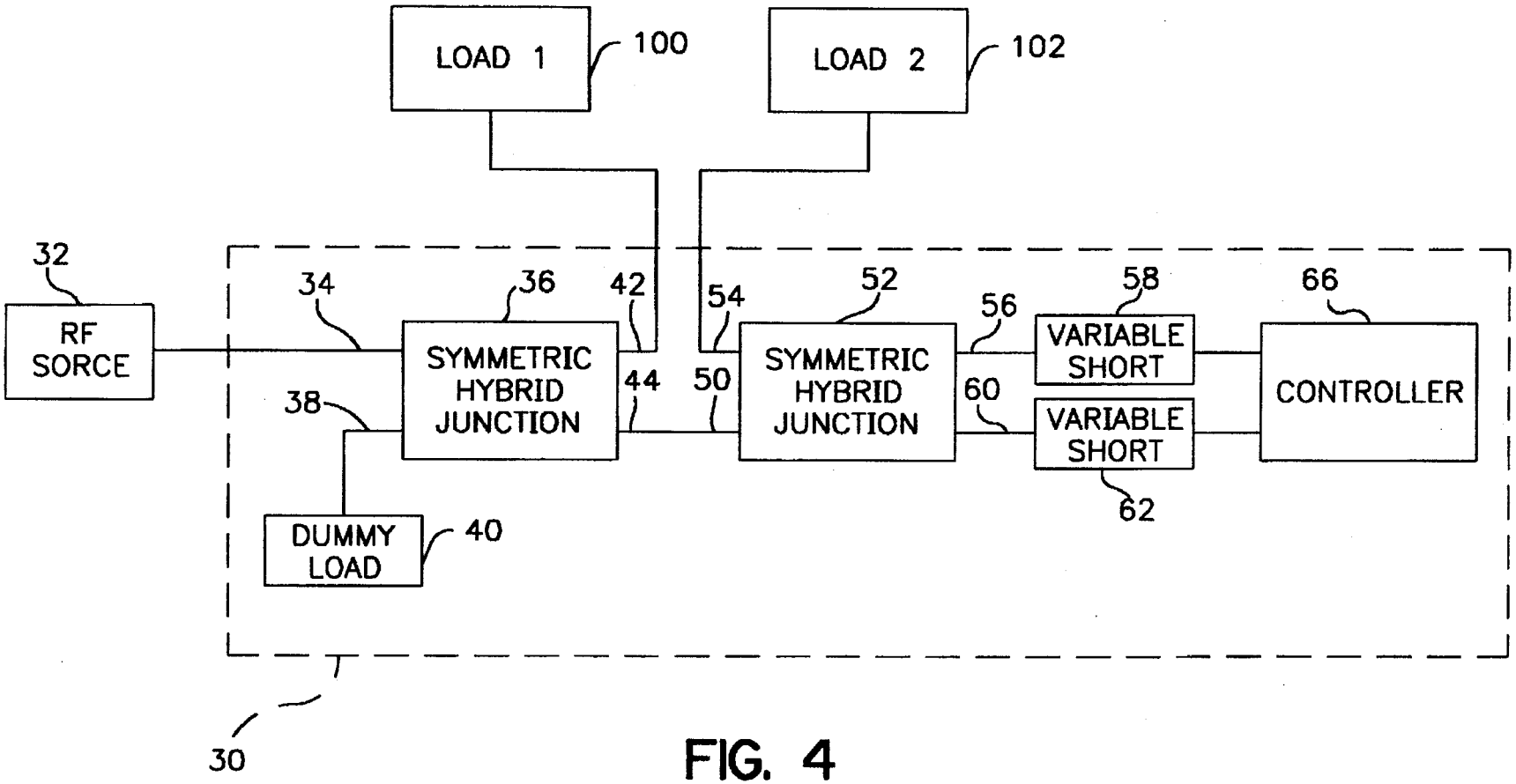
FIG. 4 is a block diagram of microwave control apparatus in accordance with the present invention used to control a phased array radar transmitter.

A general block diagram of the microwave power control apparatus of the present invention is shown in FIG. 4. Like elements in FIGS. 1 and 4 have the same reference numerals which are not all described in the discussion herein of FIG. 4. In the embodiment of FIG. 4, the microwave power control apparatus is used for supplying RF power to a first load 100 and a second load 102. In particular, second port 42 of symmetric hybrid junction 36 supplies RF power to load 100, and third port 54 of symmetric hybrid junction 52 supplies RF power to load 102. By adjusting the positions of variable shorts 58 and 62, the amplitude of the RF power supplied to load 102 and the phase shift between the RF power supplied to loads 100 and 102 can be changed. Amplitude and phase can be controlled independently as described above. In one example, the loads 100 and 102 can be antennas in a phased array radar system. The control apparatus is used to control the amplitude and phase of the RF power supplied to the antennas.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A linear accelerator system comprising:

a linear accelerator comprising a charged particle source for generating charged particles, and first and second accelerator guide sections operatively connected in series for accelerating said charged particles therethrough, said charged particle source being coupled to said first accelerator guide to feed electrons to said first accelerator guide section;

a first hybrid junction having a first port for receiving input RF power, a second port coupled to said first accelerator guide section, a third port coupled to a dummy load, and a fourth port;

a second symmetric hybrid junction having a first port coupled to the fourth port of said first hybrid junction, a third port coupled to said second accelerator guide section to apply the input RF power to said second accelerator guide section in parallel to the input RF power applied to said first accelerator guide section, and second and fourth ports;

a first variable short circuit element coupled to the second port of said second symmetric hybrid junction; and a second variable short circuit element coupled to the fourth port of said second symmetric hybrid junction, wherein the input RF power reflected by said first and second variable short circuit elements is directed through the third port of said second symmetric hybrid junction to said second accelerator guide section to produce an adjustable output electron beam from said second accelerator guide section.

2. A linear accelerator system as defined in claim 1 wherein said control means includes means, operatively connected to said first and second short circuit elements, for adjusting said variable short circuit elements so as to vary the amplitude of said input RF power supplied to said second accelerator guide section while maintaining a constant phase relationship between said input RF power supplied to said first and second accelerator guide sections.

3. A linear accelerator system as defined in claim 1 wherein said control means includes means, operatively connected to said first and second short circuit elements, for adjusting said first and second variable short circuit elements by equal increments so as to vary a phase difference between said input RF power supplied to said first and second accelerator guide sections.

4. A linear accelerator system as defined in claim 1 further including control means, operatively connected to said first and second short circuit elements, for adjusting said first and second variable short circuit elements so as to control said input RF power supplied to said second accelerator guide section.

5. A linear accelerator system as defined in claim 4 wherein said control means comprises a first linear stepping motor for adjusting said first variable short circuit element and a second linear stepping motor for adjusting said second variable short circuit element.

6. A linear accelerator system as defined in claim 4 in which said second port of said first hybrid junction is coupled to a first directional coupler connected to said first accelerator guide section.

7. A linear accelerator system as defined in claim 6 in which said third port of said second symmetric hybrid junction is coupled to a second directional coupler connected to said second accelerator guide section.

8. A linear accelerator in accordance with claim 1 including an output beam window and in which said first and said second accelerator guide sections are in line and said charged particles travel in a straight line path from said source through said first and second accelerator sections and out said output beam window.

9. Control apparatus for a linear accelerator comprising a charged particle source for generating charged particles, and first and second accelerator guide sections operatively connected in series for accelerating said charged particles therethrough, said control apparatus comprising:

a first hybrid junction having a first port for receiving input RF power, a second port coupled to said first accelerator guide section, a third port coupled to a dummy load, and a fourth port;

a second symmetric hybrid junction having a first port coupled to the fourth port of said first hybrid junction, a third port coupled, in parallel, to the connection of the first hybrid junction to the first accelerator guide section by being connected to said second accelerator guide section, and second and fourth ports;

a first variable short circuit element coupled to the second port of said second symmetric hybrid junction;

a second variable short circuit element coupled to the fourth port of said second symmetric hybrid junction, wherein the input RF power reflected by said first and second variable short circuit elements is controllably directed through the third port of said second symmetric hybrid junction to said second accelerator guide section in parallel with the input RF power fed to said first accelerator; and control means, operatively connected to said first and second short circuit elements, for adjusting, said first and second variable short circuit elements so as to control said input RF power supplied to said accelerator guide sections to output an adjustable electron beam from said accelerator.

10. Control apparatus as defined in claim 9 wherein said control means, is operatively connected to said first and second short circuit elements, for adjusting said variable short circuit elements so as to vary the amplitude of said input RF power supplied to said second accelerator guide section while maintaining a constant phase relationship between said input RF power supplied to said first and second accelerator guide sections.

11. Control apparatus as defined in claim 9 wherein said operatively connected means comprises a first linear stepping motor, operatively connected to said first short circuit elements, for adjusting said first variable short circuit elements and a second linear stepping motor, operatively connected to said second short circuit elements, for adjusting said second variable short circuit elements.

12. Control apparatus as defined in claim 9 wherein said control means includes means, operatively connected to said first and second short circuit elements, for adjusting said first and second variable short circuit elements by equal increments so as to vary a phase difference between said input RF power supplied to said first and second accelerator guide sections.

13. Control apparatus for controlling input RF power supplied to a first load and to a second load, said apparatus comprising:

a first hybrid junction having a first port for receiving said input RF power, a second port coupled to said first load, a third port coupled to a dummy load, and a fourth port;

a second hybrid junction having a first port coupled to the fourth port of said first hybrid junction, a third port coupled to said second load, and second and fourth ports;

a first variable short circuit element coupled to the second port of said second hybrid junction; a second variable short circuit element coupled to the fourth port of said second hybrid junction, wherein said input RF power fed to and reflected by said first and second variable short circuit elements is controllably directed through the third port of said second hybrid junction to said second load; and control means, operatively connected to said first and second short circuit elements, for adjusting said first and second variable short circuit elements so as to control the input RF power supplied to said second load.

14. Control apparatus as defined in claim 13 wherein said first load comprises a first accelerator guide section of a linear accelerator and said second load comprises a second accelerator guide section of said linear accelerator.

15. Control apparatus as defined in claim 13 wherein said control means includes means for adjusting said first and second variable short circuit elements by equal increments so as to vary a phase difference between RF voltages supplied to said first and second loads.

16. Control apparatus as defined in claim 13 wherein said control means includes means for adjusting said variable short circuit elements so as to vary the amplitude of the input RF power supplied to said second load and to maintain a constant phase relationship between the input RF power supplied to said first and second loads.

* * * * *

UNITED STATES PATENT AND TRADEMARK OFFICE

CERTIFICATE OF CORRECTION

PATENT NO. : 5,661,377

DATED : August 26, 1997

INVENTOR(S) : MISHIN ET AL.

It is certified that error appears in the above-indentified patent and that said Letters Patent is hereby corrected as shown below:

Column 6, lines 48 and 56, change "wherein said control means includes means," to -- further including control means --.

Signed and Sealed this

Ninth Day of June, 1998

*Attest:*

*Attesting Officer*

Bruce Lehman

BRUCE LEHMAN

*Commissioner of Patents and Trademarks*